United States Patent [19]

Bohannon, Jr. et al.

[11] Patent Number: 4,482,413

[45] Date of Patent: Nov. 13, 1984

[54] METHODS OF AND APPARATUS FOR FORMING STRIPS OF NON-METALLIC AND METALLIC MATERIAL INTO TUBULAR COVERS HAVING OVERLAPPED SEAMS

[75] Inventors: William D. Bohannon, Jr., Lawrenceville; Alfred S. Hamilton, Norcross, both of Ga.

[73] Assignee: AT&T Technologies, Inc., New York, N.Y.

[21] Appl. No.: 528,307

[22] Filed: Aug. 31, 1983

[51] Int. Cl.[3] ..... H01B 13/26

[52] U.S. Cl. ..... 156/54; 29/33 E; 29/825; 72/52; 156/56; 156/203; 156/463; 174/105 R; 174/107; 228/148; 264/272.12; 428/129; 428/379

[58] Field of Search ..... 29/33 D, 33 E, 825, 29/828; 72/51, 52; 156/54, 56, 201, 203, 461, 463; 174/105 R, 107; 228/148; 264/171, 174, 272.11, 272.12; 428/129, 375, 379

[56] References Cited

U.S. PATENT DOCUMENTS

| | | | |
|---|---|---|---|
| 3,340,353 | 9/1967 | Mildner | 174/105 R X |
| 3,615,977 | 10/1971 | Lehner et al. | 156/54 X |
| 3,785,048 | 1/1974 | Petersen | 174/105 R X |
| 4,035,211 | 7/1977 | Bill et al. | 156/54 |
| 4,100,003 | 7/1978 | Trusch | 156/54 |
| 4,221,926 | 9/1980 | Schneider | 156/56 X |
| 4,308,662 | 1/1982 | Bohannon | 29/828 |
| 4,360,395 | 11/1982 | Suzuki | 156/54 |
| 4,377,908 | 3/1983 | Pan | 29/828 |
| 4,404,720 | 9/1983 | Bohannon | 29/33 E |

*Primary Examiner*—Robert A. Dawson
*Attorney, Agent, or Firm*—E. W. Somers

[57] ABSTRACT

A strip (56) of non-metallic material and one (59) of a metallic material are wrapped simultaneously about an advancing cable core (32) to enclose partially the core. Then longitudinal edge portions (71, 72) of the strip of non-metallic material are separated by a shoe (150) which permits movement of the edge portions in a direction circumferentially of the core. One longitudinal edge portion (72) of the non-metallic strip becomes confined in a guideway (118) of a tool (99) and longitudinal edge portions (73, 74) of the metallic strip (59) are guided along guideways (117, 118) of the tool as the strips are moved through a converging passageway (103). This controls the relative circumferential movement between the edge portions as the strips are moved through the passageway to form a core wrap (33) and a shield (34). As a result, the longitudinal edge portions of the non-metallic and metallic strips are caused to form seams which are aligned radially of the core and which are overlapped in opposite circumferential directions. This arrangement obviates the necessity for binding the core wrap prior to the forming of the shield.

23 Claims, 25 Drawing Figures

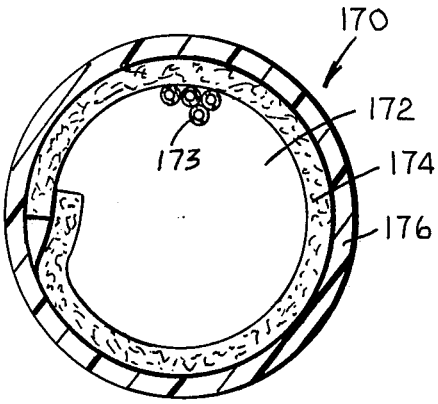
Fig. 17
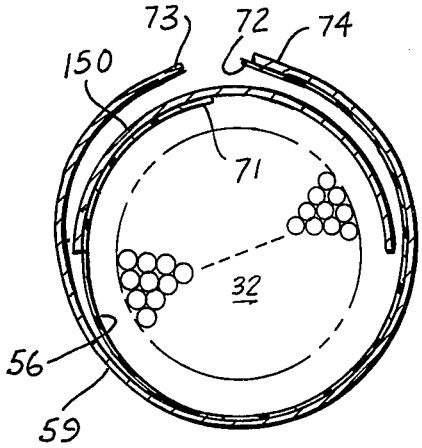
Fig. 12
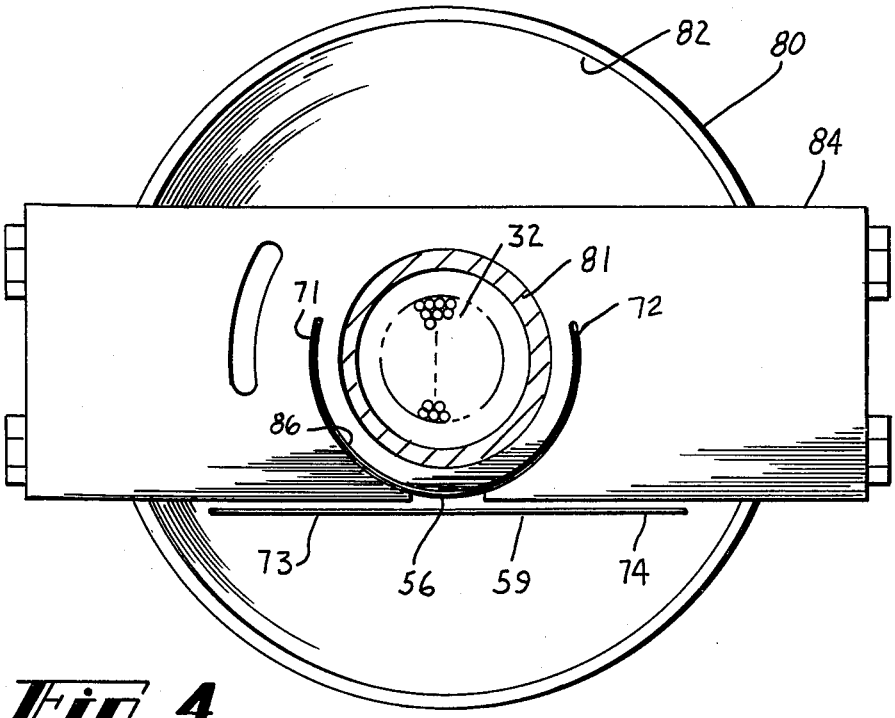
Fig. 4
Fig. 21
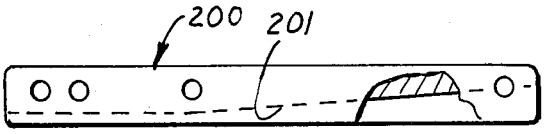

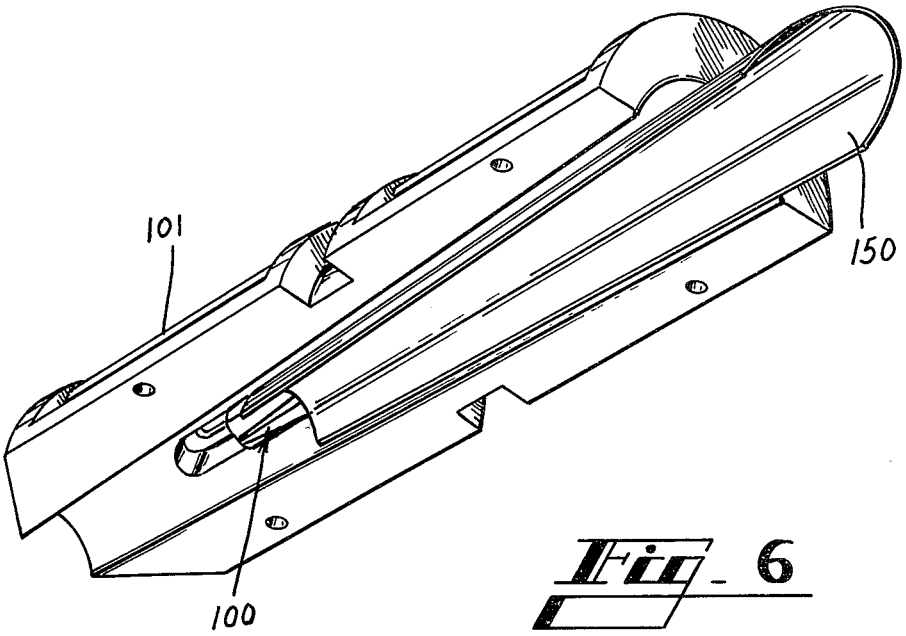
Fig. 6
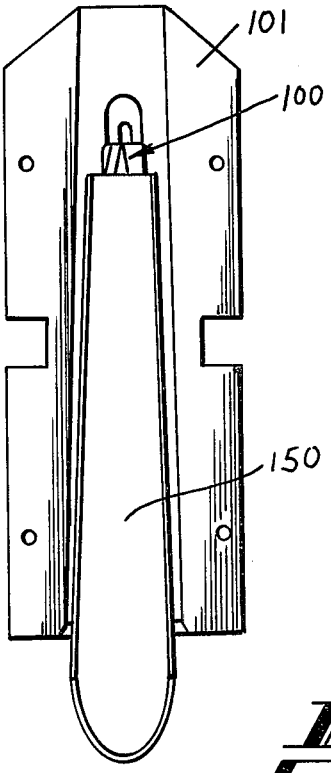
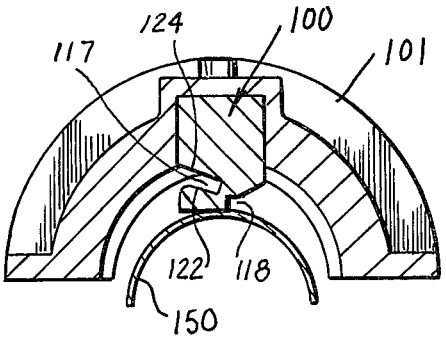
Fig. 8
Fig. 7

METHODS OF AND APPARATUS FOR FORMING STRIPS OF NON-METALLIC AND METALLIC MATERIAL INTO TUBULAR COVERS HAVING OVERLAPPED SEAMS

TECHNICAL FIELD

This invention relates to methods of and apparatus for forming strips of non-metallic and metallic material into tubes having overlapped seams. More particularly, it relates to methods of and apparatus for forming simultaneously strips of metallic and non-metallic material into concentric tubular members having aligned, longitudinal overlapped seams about an advancing cable core.

BACKGROUND OF THE INVENTION

In the manufacture of a communications cable, a core comprising a plurality of insulated conductors is enclosed in a strip of non-metallic material, which is referred to as a core wrap. Subsequently, the core wrap is enclosed by other components of a sheath system such as, for example, an aluminum shield and a jacket. The core wrap insulates the core from the aluminum shield which is designed to protect the cable core from lightning damage and from electrical disturbances. The core wrap and the shield, which often times is corrugated, are formed from continuous strips which are wrapped longitudinally with overlapped seams about an advancing cable core.

For some cables, a closed, unjoined overlapped seam for the shield is provided. In those, an outer overlapping edge portion of the metallic shield tends to rebound subsequent to forming and to project into an outer plastic jacket that is extruded around the shield. This problem has been overcome by methods and apparatus which are shown in U.S. Pat. No. 4,308,662 issued to W. D. Bohannon, Jr. on Jan. 5, 1982.

Typically, the strip of non-metallic material is wrapped about the core prior to the forming of the metallic shield thereabout. The non-metallic material, which may be a MYLAR ® plastic material, is formed into an oversized core wrap by passing the strip through a tapered tube having overlapped but spaced apart edges which forms an overlapped seam. Afterwards, a binder ribbon is wrapped spirally about the strip to hold the plastic material about the core during movement along a manufacturing line to a metal forming station. The oversized plastic core wrap is drawn down tightly on the advancing core by the binder ribbon which is under tension. Subsequently, a second binder is wrapped spirally about the core wrap and the tension therein causes it to further draw down the core wrap. This may cause the first binder ribbon to become loose and possibly entangled with portions of the manufacturing apparatus. Also, if the second binder ribbon should break, the core wrap may be disposed somewhat loosely about the core by the time it reaches the metallic forming station.

This process for providing a core wrap has several other shortcomings. For example, the application of a binder to draw down the core wrap prior to the wrapping of a metallic strip thereabout requires the use of a relatively low line speed. Also, this process is wasteful from a material standpoint. When it is drawn down by the use of binder tension, the core wrap material tends to become wrinkled. To insure complete coverage of the core, the width of the strip of core wrap material is greater than the circumference plus overlap of a perfectly formed, non-wrinkled tubular cover. Further, because the strip of plastic material is wrapped about the core some distance prior to the forming of the metallic strip, it is required to have particular strength properties. As a result, the choice of materials for use as the core wrap has been somewhat limited.

Seemingly, the prior art is devoid of a solution of this problem. The prior art includes U.S. Pat. No. 3,615,977 which slows the formation of paper and metallic tubes having gapped longitudinal seams about an advancing core having annular discs spaced therealong. Filling material is introduced through the gapped seams after which opposing edges of the metallic tube are welded together. An arrangement for forming gapped seams is relatively simple, but does not provide a solution to the problems which are encountered as a non-metallic core wrap material and a metallic material are formed about an advancing cable core.

SUMMARY OF THE INVENTION

The foregoing problems have been overcome by the methods and apparatus of this invention. In accordance with a method of this invention for forming non-metallic and metallic tubular covers about a cable core, the cable core and strips of a relatively flexible non-metallic and of a metallic material are advanced along a path of travel. Along one portion of the path of travel, the strips are wrapped partially about the core. The longitudinal edge portions of the strip of non-metallic material are caused to be separated in a direction radially of the path of travel and allowed to be moved circumferentially of the core. Then, along another portion of the path of travel, the core and the partially formed strips are moved through a passageway which converges in the direction in which the core is advanced. One longitudinal edge portion of the non-metallic strip and both longitudinal edge portions of the metallic material are confined to control the relative circumferential movement between the edge portions as the strip is moved through the converging passageway. This causes the non-metallic strip and the metallic strip to be formed simultaneously into a substantially smooth core wrap and shield, respectively, each having a longitudinal overlapped seam. The seams are aligned radially of the core to provide additional insulation against electrical arcing along an inner longitudinal edge portion of the metallic shield which is contiguous with the core wrap. Also, the overlapping of the covers is accomplished such that the circumferential direction from the inner longitudinal edge portion of the core wrap to its outer longitudinal edge portion is opposite to that for corresponding edge portions of the shield.

In one embodiment, the core is advanced through a tube disposed within a core former through which a strip of plastic material and one of metallic material are moved. The plastic strip is caused to be formed into a partially curved configuration at an entrance to the cone former. As they are moved through the cone former, the strips are formed into partially tubular members each having a gapped longitudinal seam. The longitudinal edge portions are separated by causing them to be disposed on opposite sides of a longitudinally extending shoe which has a curved configuration. At this time, the longitudinal edge surfaces of the non-metallic strip are free to move circumferentially of the core. Then, the two partially formed strips are moved through a converging passageway past a forming tool which includes provisions for confining both longitudinal edge portions of the metallic strip and one longitudinal edge portion of the plastic strip. The forming tool cooperates with the converging passageway to form the overlapped seam on the metallic shield and cooperates with the shoe and converging passageway to form the overlapped seam in the core wrap. Inasmuch as the shield is formed about the core simultaneously with the strip of plastic material, the application of a binder ribbon about the core wrap is not required.

In another embodiment, a strip of non-metallic material is formed about the core as before and then bound with a ribbon to hold it in place during its movement to apparatus which, for example, may extrude a jacket thereover. A forming tool in that embodiment includes provisions for confining the one longitudinal edge portion of the non-metallic material. It cooperates with the shoe and the converging passageway to form a tubular cover which is in substantial engagement with the core.

BRIEF DESCRIPTION OF THE DRAWINGS

Other features of the present invention will be more readily understood from the following detailed description of the specific embodiments thereof when read in conjunction with the accompanying drawings, in which:

FIG. 4 is an end view of an entrance section of the forming system in FIG. 3;

FIG. 6 shows a perspective view of a top portion of an overlap and forming tool of a die section of FIG. 3;

FIG. 7 is a plan view of the top portion of the overlap and forming tool of FIG. 6 as taken from its underside;

FIG. 8 shows an enlarged cross-sectional view of the top portion of the overlap and forming tool;

FIG. 12 is an end view of the strips of plastic and metallic material after the longitudinal edge portions of the plastic strip have been separated radially of the core;

FIG. 17 is an end cross-sectional view of another cable which is made with the methods and apparatus of this invention;

FIG. 21 is a plan view of the key of FIG. 19; and

DETAILED DESCRIPTION

Figure 5:
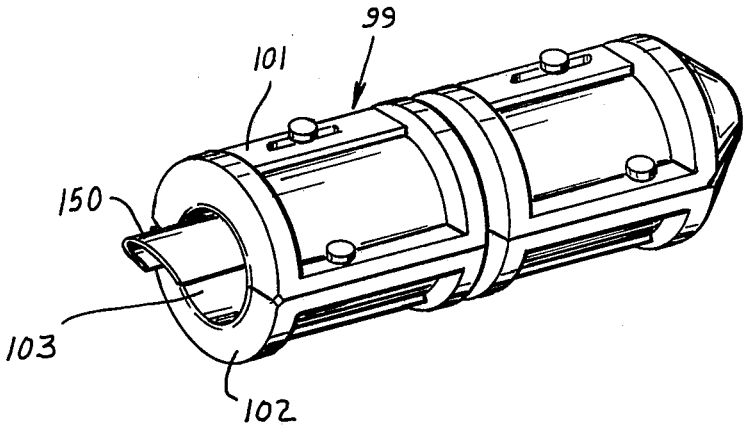
FIG. 5 is a perspective view of a portion of the system of FIG. 3.

In one commonly manufactured communications cable 30 (see FIG. 1), a plurality of twisted pairs of insulated conductors 31—31 are stranded together to form a cable core designated generally by the numeral 32. The core 32 is enclosed by a core wrap 33 having an overlapped seam 35 and by a corrugated aluminum shield 34 having a longitudinal overlapped seam 36. In some cables, an outer steel shield having a longitudinal overlapped seam is provided for rodent and mechanical protection. The shielded core 32 is enclosed with a jacket 39 of plastic material such as polyethylene, for example.

The seam 36 of the shield 34 includes a portion 45 which is turned toward the cable core 32 to preclude the end portion of the shield from protruding into the jacket 39. This portion engages a linear underlying edge portion 48 to form a substantially closed seam.

Figure 2:
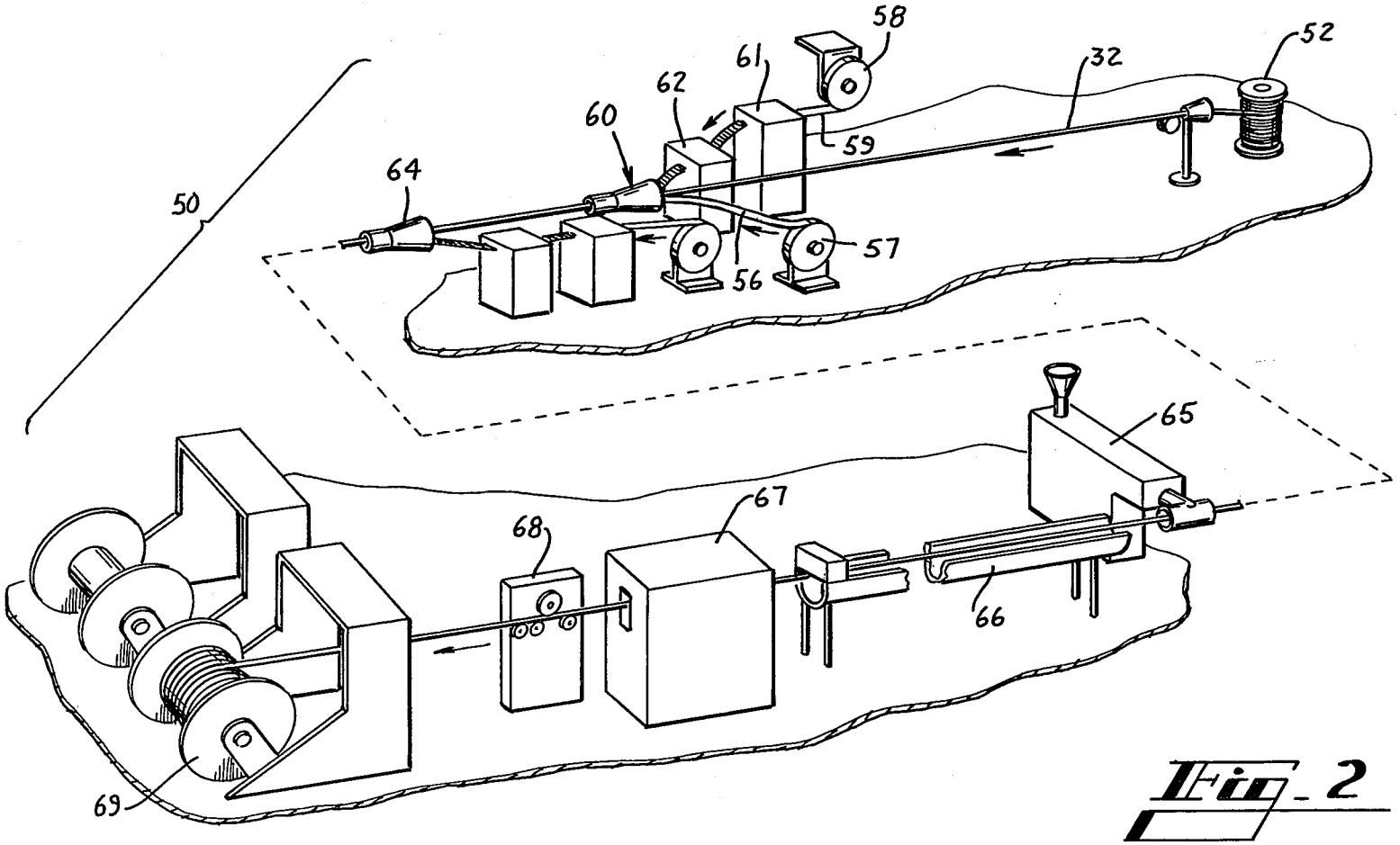
FIG. 2 is a perspective view of a manufacturing line for forming a core wrap, two metallic shields, and a plastic jacket about a cable core.

In a typical cable sheathing line such as is shown in FIG. 2 and designated generally by the numeral 50, the cable core 32 is payed off from a reel 52. A strip 56 of plastic material which is used to provide the core wrap 33 is payed out from a supply 57. From a roll 58, an unformed aluminum strip or tape 59 is advanced into a corrugator 61 and coated with a waterproofing compound by an applicator 62. Then the strips 56 and 59 together with the core 32 are advanced along a path of travel 63 (see FIG. 3) through a forming system 60. Therein, the strip 56 and the metallic strip 59 are wrapped simultaneously about the advancing cable core 32. Should a steel shield be used to enclose the aluminum shield, tooling 64 similar to that shown in priorly identified W. D. Bohannon U.S. Pat. No. 4,308,662, which is incorporated by reference hereinto, may be used to form it. The shielded core 32 is then passed through an extruder 65 which applies the plastic jacket 39 about the shield. The jacket 39 is cooled in a water trough 66 after which the cable 30 is moved through a capstan 67, a footage counter and marker 68, and taken up on a reel 69.

Turning now to the forming of the shield 34 and the core wrap 33, the plastic strip 56 and the metallic strip 59 are moved under tension into the forming system 60 (see FIG. 3), wherein they are wrapped longitudinally about the core 32. Portions of the system 60 engage in a particular manner longitudinal edge portions 71 and 72 of the plastic strip 56 (see FIG. 4) and longitudinal edge portions 73 and 74 of the metallic strip 59 to insure that the core wrap 33 and shield 34 are formed in a predetermined configuration. The system 60 comprises a preparation section 76, a transition section 77, and a die section 78, all supported by a housing 79. It is designed to form each strip 56 and 59 from a planar cross-sectional configuration into one which is substantially circular and which encloses the cable core 32 with a substantially closed seam. Further, the forming system 60 is effective to cause the core wrap 33 to have a substantially smooth configuration.

Figure 3:
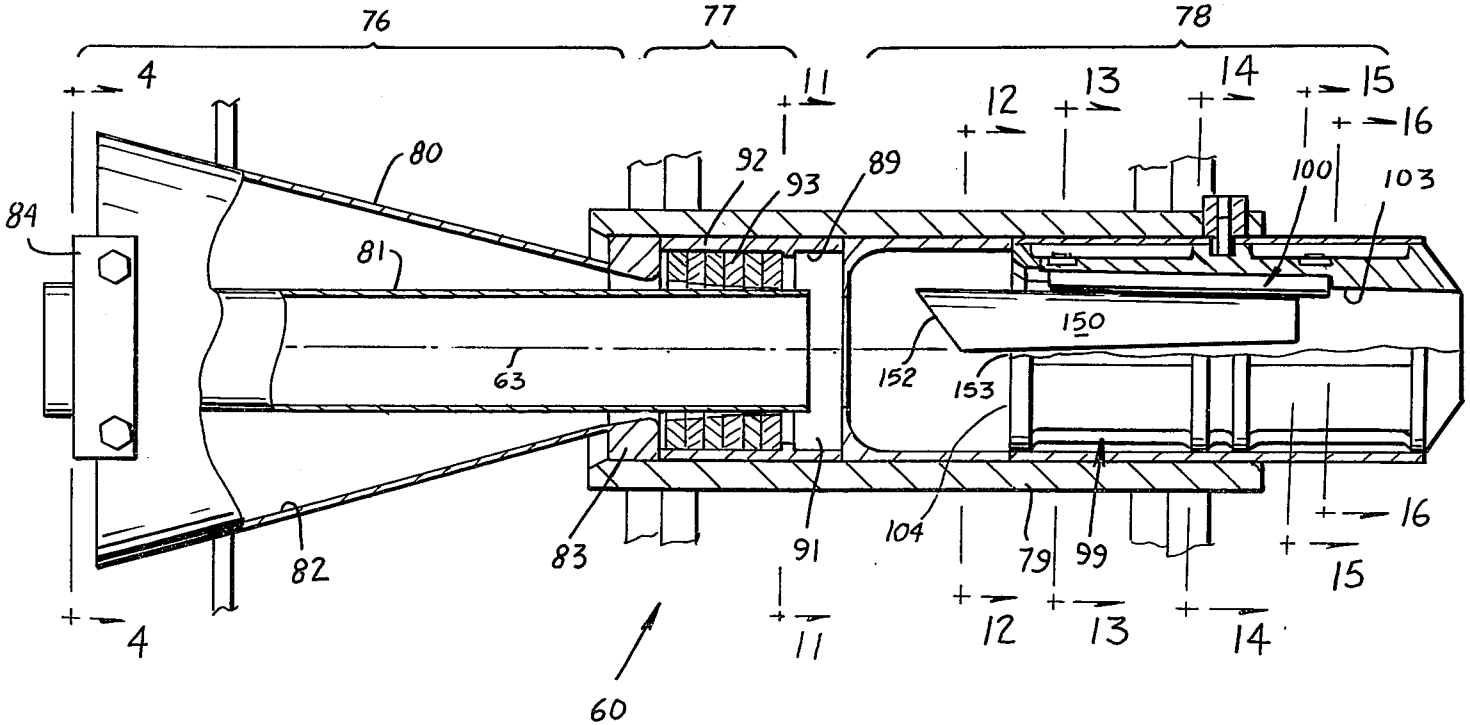
FIG. 3 shows an elevational view partially in section of a system for forming simultaneously the core wrap and a metallic shield about an advancing cable core.

The preparation section 76 (see FIG. 3) includes a cone former 80 and a centrally disposed tube 81 through which the cable core 32 is advanced. The circumference of the tube 81 is greater than the width of either strip 56 or 59. Disposed about the tube 81 is a truncated conically shaped surface 82 having a line of generation which makes an angle of about 15° with the axis of the tube 81. As is seen in FIG. 3, the surface 82 provides a conically shaped opening through which the strips 56 and 59 are advanced. A downstream end of the cone former 80 has a collar 83 attached thereto to mount the cone former to one end of the housing 79.

As the strips 56 and 59 are advanced together with the core 32 into the cone former 80 and through the transition and die sections 77 and 78, respectively, tensile forces are caused to be applied to them by the advancing core and by payoff facilities. The application of these forces to the strips is helpful during the forming of the core wrap 33 and the shield 34. This is particularly true for the plastic strip 56 for which the forces supply the back tension which permits the partial forming of the core wrap while it is unsupported between the entrance and exit of the cone former 80.

Viewing now FIG. 4, there is shown an end view of an entrance end of the cone former 80 as the plastic and metallic strips 56 and 59 are advanced thereinto. As the metallic strip 59 engages the wall 82 of the cone former 80 and is moved therealong, it is caused to assume a generally U-shape.

At the same time that the metallic strip 59 is being advanced through the cone former 80, the strip 56 of plastic material destined to form the core wrap 33 is fed through an entrance guide 84 (see FIG. 4). The entrance guide 84 spans across the large diameter portion of the cone former 80 and includes a U-shaped slot 86. The plastic material is passed through the U-shaped slot 86 and then toward the small diameter portion of the cone former.

After the metallic strip 59 and the plastic core wrap material leave the cone former 80, they enter the transition section 77. The exit end of the tube 81 extends beyond the collar 83 into a portion 89 of a cavity 91 in an annular support member 92. A plurality of cone extension rings 93—93 are mounted within the cavity 91 and interposed between the tube 81 and the housing 79.

The plurality of rings 93—93 provide a gentle change from the cone former 80 to the die section 78. They have successively decreasing inner diameters with an inner peripheral edge of each being rounded to prevent damage to the plastic and metallic strips as they are moved therepast. Suitable clearance is provided between the rings and the outside diameter of the tube 81 to accommodate the plastic and metallic strips 56 and 59.

In the transition section 77, the longitudinal edge portions of the strips 56 and 59 are further turned inwardly between the rings 93—93 and the tube 81. This further forms the strips 56 and 59 toward a circular cross-sectional configuration with the longitudinal edges of each strip adjacent to each other but spaced apart and adapted to be received by tooling in the die section 78.

Successive increments of the strips 56 and 59 are then moved from the transition section 77 into and through the die section 78 (see FIG. 3) wherein the longitudinal edge portions of each are formed into overlapped relation by a tool 99 (see also FIG. 5). The tool 99 is positioned along another portion of the path of travel 63 through the forming system 60. The longitudinal edge portions 73 and 74 of the strip 59 and one longitudinal edge section 72 of the plastic core wrap material 56 are moved into engagement with guideways of a forming key, designated generally by the numeral 100 (see FIGS. 3 and 6–8) which is mounted in a first die half 101 of the tool 99. The first half 101 is mateable with a second half 102. When assembled, die halves 101 and 102 provide a passageway 103 which converges in the direction in which the core is advanced. The converging passageway 103 is tapered slightly along its length with a larger cross-section at an entrance or upstream end 104 of the tool 99.

Figure 1:
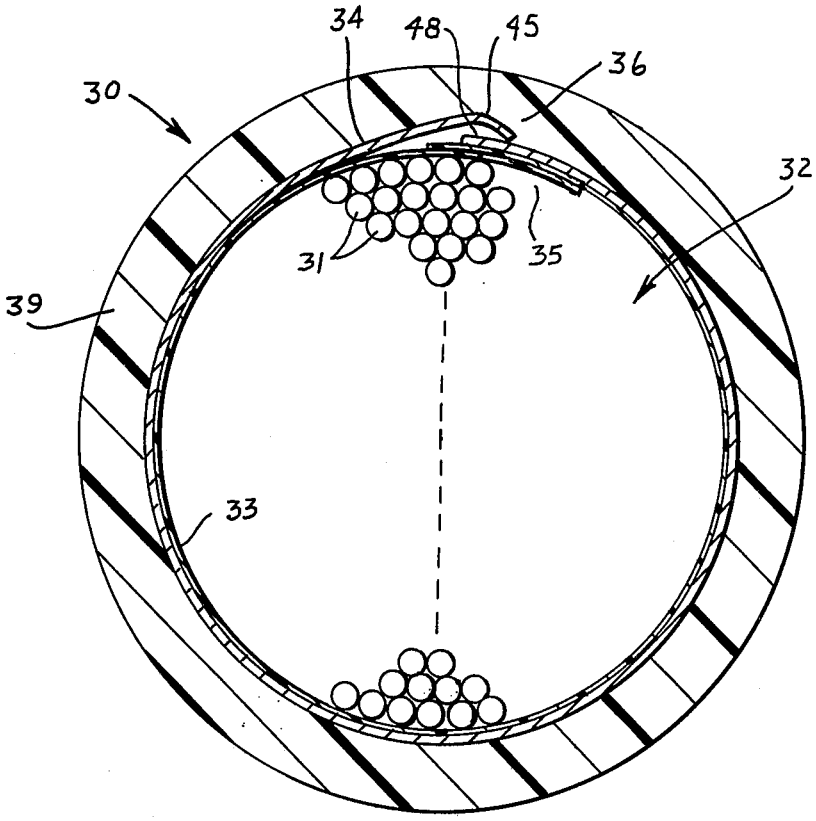
FIG. 1 is a cross-sectional end view of a cable which is made in accordance with the methods and apparatus of this invention.

As shown in FIG. 3, the key 100 is positioned along a top portion of the converging passageway. It may be repositioned by rotating the tool 99 to cause the seams to be formed at locations other than those shown in the drawings. Generally, the positioning of the key 100 in a position diametrically opposite to that shown in FIG. 3 should be avoided inasmuch as the weight of the core 32 may inhibit the formation of the longitudinal seams. The key 100 cooperates with the converging passageway 103 to cause longitudinal edge portions of the strip 59 to form the overlapping seam 36 of the shield 34 with formed extremities 45 and 48 as illustrated in FIG. 1. Also, the key 100 cooperates with the passageway 103 and with other portions of the tooling 99 to cause the longitudinal edge portions 71 and 72 of the strip 56 to form an overlapping seam.

Figure 9:
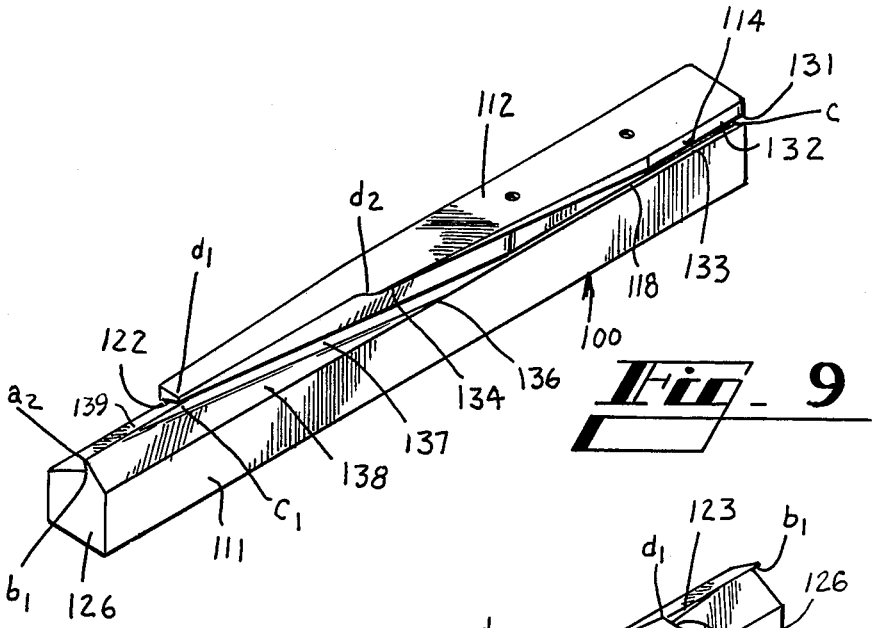
FIG. 9 is an enlarged perspective view of a portion of the overlap and forming tool.
Figure 10:
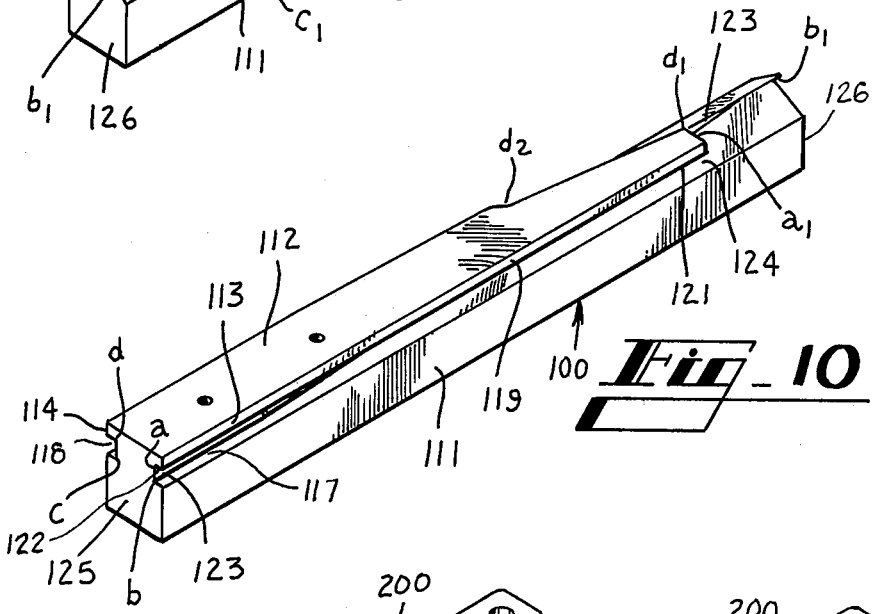
FIG. 10 is another view of the portion of the overlap and forming tool shown in FIG. 9.

Reference will be made to FIGS. 9–10 to describe the key 100, but it should be understood that in these two figures the key is inverted from its position shown in the remainder of the drawings. As is seen, the key 100 includes a body 111 and a tapered portion 112 which form two overhanging side portions 113 and 114. The side portions 113 and 114 taper inwardly and together with the body 111 form grooves or guideways 117 and 118. The guideway 117 forms the overlying edge portion 73 of the shield 34 while the guideway 118 forms the underlying edge portion 74 and the overlying edge portion 72 of the core wrap 33.

Turning now to the portion of the key 100 which defines the guideway 117, it is seen that the side portion 113 extends parallel to the body along a length 119 (see FIG. 10) after which it angles slightly inwardly along a length 121. The guideway 117 which must have sufficient height to accommodate the metallic strip 59 is defined by a surface 122 of the overhanging side portion 113, by an inner wall 123 and by a surface 124. Between an entrance end 125 and an exit end 126, the configuration of the guideway 117 changes so that it extends farther toward the center line of the key 100. The surface 122 slopes inwardly and upwardly toward the exit end 126 of the key as does the surface 124 (see FIG. 8). Also, while the surface 123 is perpendicular to the surface 124 at the entrance end 125, it makes an angle therewith adjacent the exit end 126. From FIG. 10, it may be seen that point "a" at the entrance end 125 moves inwardly to point "$a_1$" and the point "b" moves inwardly to a point "$b_1$" as the guideway 117 opens near the exit end 126. This geometry causes the height of the guideway 117 at the exit end 126 to be decreased over that at the entrance end 125 and is designed to form the longitudinal edge portion 73 of the strip 59 with a generally crimped configuration 45 (see FIG. 1).

Going now to FIG. 9, it will be seen that the guideway 118 is formed by a surface 131 of the side overhang 114, an inner wall 132, and a surface 133. The side portion 114 and the guideway 118 decrease in height as they extend toward the exit end 126 with the height being sufficient to accommodate the combined thicknesses of the metallic and the plastic strips 59 and 56. The point "c" moves inwardly to a point "$c_1$" while the point "d" moves inwardly to the point "$d_1$". The overhanging portion 114 ends in the vicinity of a point 134 whereat point "d" has become point "$d_2$". As is seen, the surface 133 transitions into surfaces 137 and 138 in the vicinity of a point 136 with the surface 137 ending in an apex 139 adjacent to the exit end 126. This side of the key 100 causes the inner edge portion 74 of the metallic strip 59 and the outer edge portion 72 of the plastic strip 56 to assume the configuration shown in FIG. 1.

The apparatus 60 also includes a shoe 150 which is attached to the tool 99 as shown in FIGS. 3 and 6–8. For purposes of clarity, the shoe 150 has not been shown in FIGS. 9–10. It has a generally semicircular shape which decreases in radius along the length of the converging passageway 103 with longitudinal edges thereof in one embodiment being oriented downwardly (see FIG. 8). The shoe 150 cooperates with the key 100 and the converging passageway 103 to cause the plastic core wrap material to be disposed about the core 32 and to have an overlapped seam. An end portion 152 of the shoe 150 which is first engaged by the plastic strip 56 extends beyond the entrance to the converging passageway 103 and toward the rings 93—93. Also, it is beveled to avoid otherwise right angle corners which might damage the plastic material.

In operation, a leading end of a supply of a metallic strip 59 is tapered to facilitate its insertion into the passageway 103 of the tool 99. Successive increments of the metallic strip 59 are corrugated and together with the core wrap plastic 56 and the core 32 are passed through the preparation section 76. The core 32 is inserted into the tube 81 in the preparation section 76. A leading end of the plastic strip 56 is inserted into the slot 86 of the entrance guide 84. The metallic strip 59 is disposed to one side of the frame which supports the entrance guide 84 having the U-shaped slot 86 (see FIG. 4).

Figure 11:
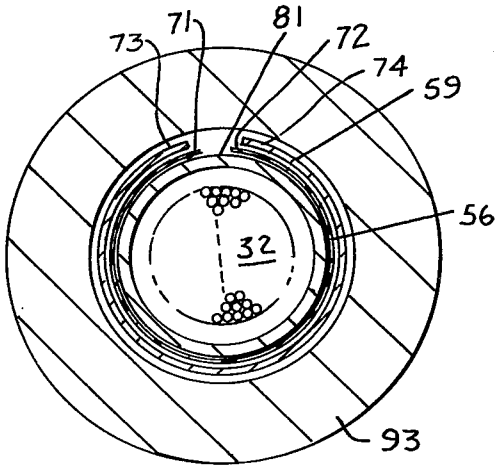
FIG. 11 is an end view of plastic and metallic strips at an exit to a portion of the forming system of FIG. 3 and taken along lines 11—11 thereof.

In the preparation section 76, the strip 59 and the strip 56 are partially formed around the tube 81 in a substantially U-shaped configuration, as shown in FIG. 11, with gaps between longitudinal edges thereof. As the core 32 with the partially formed core wrap 33 and shield 34 therearound pass into the transition section 77, the somewhat U-shaped configuration of each is altered so that the free ends of the "U" will be curved and spaced to enter the tool 99 of the die section 78. The rings 93—93 are effective to prepare the edge portions 73 and 74 of the strip 59 and the one edge portion 72 of the plastic strip 56 so that they will enter the guideways 117 and 118 of the key 100 in the die section 78.

As was mentioned hereinbefore and as can best be seen in FIG. 3, an upstream end 152 of the shoe 150 extends beyond the entrance to a portion 153 of the converging passageway 103 which is formed by the tool halves 101 and 102. This portion is effective to cause the longitudinal edge portions 71 and 72 to be separated in a direction radially of the path of travel of the core 32 (see FIG. 12). In this portion of the arrangement, forces are not applied to the edge surfaces of the strip 56 of plastic material. As a result, they are free to move in a direction circumferentially of the core 32.

Figure 13:
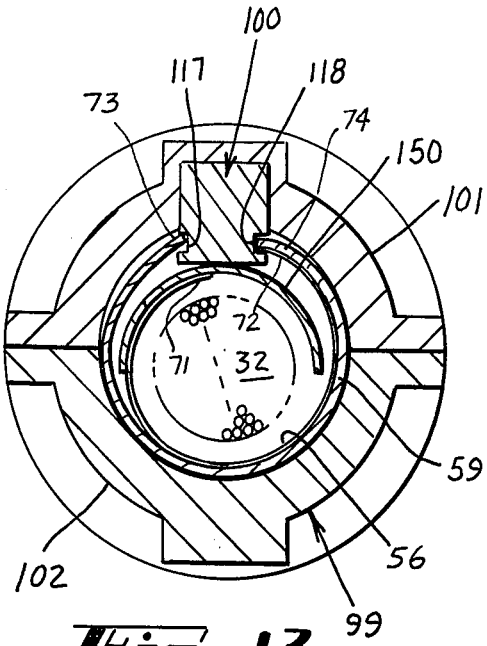
FIGS. 13–16 are a sequence of end cross-sectional views taken along the forming tool of FIG. 3 with plastic and metallic strips shown at different stages of their formation into the core wrap and shield, each having an overlapped seam.

Then, the strip 56 is moved along the key 100 and its outer longitudinal edge portion 72 is confined by the guideway 118 (see FIG. 13). The inner longitudinal edge portion 71 continues to be disposed on an inner side of the shoe 150 adjacent to the core 32. In that position, the other longitudinal edge portion 71 of the plastic strip 56 is supported to prevent wrinkling. This arrangement causes forces to be applied to the edge surface of the outer longitudinal edge portion 72 of the strip 56 to control the relative circumferential movement between it and the inner longitudinal edge portion 71.

Figure 14:
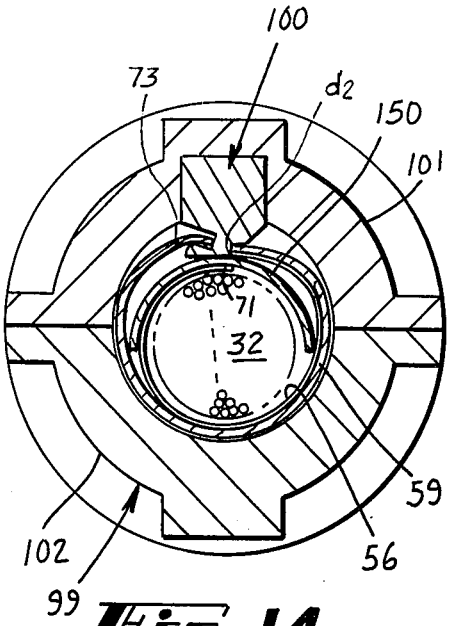

As the partially formed shield 34 enters the tool 99, the longitudinal edge portion 73 of the metallic strip 59 becomes confined in the guideway 117 and the outer edge portion 74 together with the one edge portion 72 of the strip 56 confined in the guideway 118 (see FIG. 13). The longitudinal edge portions 73 and 74 of the metallic strip 59 abut or substantially abut the side walls 123 and 132 of the guideways 117 and 118 of the key 100. If reference is made of FIGS. 14–16, the formation of the edge portions 73 and 74 is shown at several other locations along the length of the key 100.

Both edge portions 73 and 74 of the metallic strip are positively controlled during the forming thereof in the die section 78. The underlying edge portion 74 is supported along its longitudinal edge surface and portions of its major surfaces adjacent the edge along at least a portion of the length of the key 100. Specifically, the surface 131 of the guideway 118 extends to the point "$d_2$" (see FIGS. 9–10 and 14) after which only the longitudinal edge surface and an outwardly facing major surface of the edge portion 74 and the plastic strip 56 are supported by the key 100. Because of the guideway 118 and its cooperation with the shoe 150 between points "$d_2$" and "$d_1$" (see FIGS. 9 and 15), deflection of the underlying edge portion 74 is prevented while the overlying edge portion 73 is being directed inwardly.

Figure 15:
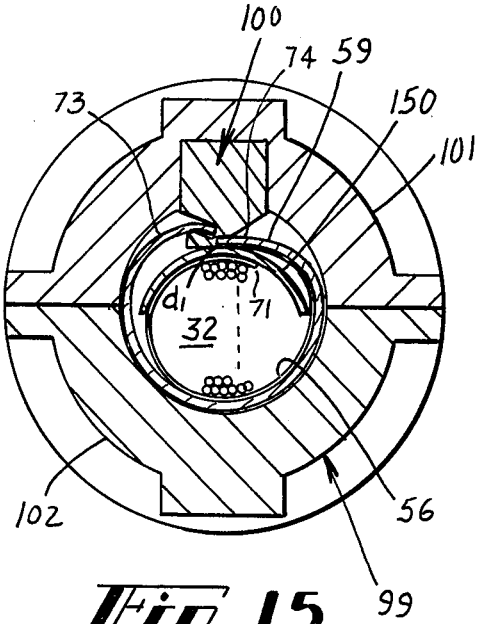

As the core 32 passes beyond the point "$d_1$", the two edge portions 71 and 72 of the plastic strip and the two edge portions 73 and 74 of the metallic strip 59 begin to overlie each other (see FIG. 15). The edge portion 73 of the shield 34 being the outer or overlying edge portion is directed inwardly into substantially continuous engagement with the edge portion 74.

Figure 16:
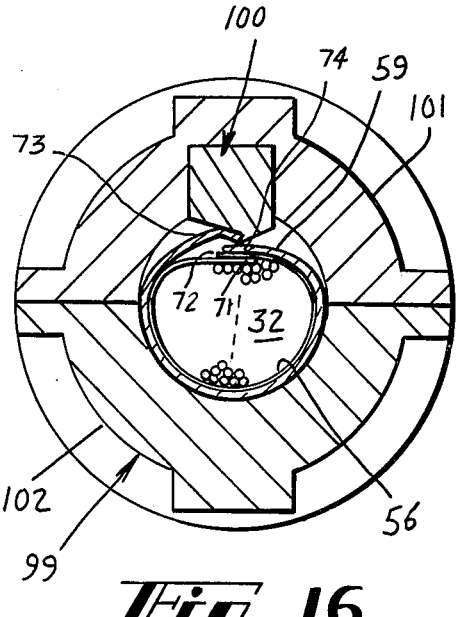

Since the passageway 103 continues to converge in the direction in which the core 32 is advanced after the key 100 ends, the core 32 is sized from its exaggerated configuration shown in FIG. 16 to the substantially circular configuration shown in FIG. 1 as it exits the tool 99. As a result, the plastic strip 56 which partially encloses the core at an exit of the preparation section 76 is caused to have the longitudinal overlapped seam 35. Further, the plastic core wrap 32 is in substantial engagement with the core 32. Also, the tool 99 is effective to cause the metallic strip 59 to have a substantially closed seam.

During electrical disturbances, arcing may occur at the longitudinal surfaces of the shield 34 along the seam 36. This may cause penetration of the plastic strip 56 and damage the core 32. The problem is overcome by aligning the seams 35 and 36 of the non-metallic and metallic covers radially of the core 32. This arrangement provides a double thickness of core wrap between the portion 48 of the shield 34 and the core 32.

As should be apparent from FIGS. 1 and 16, the plastic and the metallic strips 56 and 59 are formed so that they are overlapped in opposite directions about the cable core. The circumferential direction from the inner longitudinal edge portion 71 of the core wrap 33 to its outer longitudinal edge portion is counter-clockwise whereas from the inner edge portion to the outer edge portion of the shield 34 it is clockwise. This prevents the outer longitudinal edge portion 72 from protruding through the seam 36 of the metallic shield 34.

As the shielded unit leaves the die section 78, it passes to the extruder 65, the water trough 66, the capstan 67, and the footage counter and marker 68 and onto the reel 69. Or as shown in FIG. 2, the aluminum-shielded core 32 may be enclosed in a steel shield by the device 64 prior to jacketing.

The invention has been described in terms of forming simultaneously the core wrap 33 and a metallic shield 34. The metallic shield 34 is effective to hold the core wrap 33 in place in tight engagement with the core until a plastic jacket is extruded thereabout.

It should be realized that this invention also is useful in providing a plastic, fibrous or other non-metallic material core wrap 33 and in causing these to be held in place pending the application of other coverings. For example, in one fire retardant cable 170 (see FIG. 17), a core 172 comprising conductors 173—173 is covered with a fibrous material 174 followed by an extruded or wrapped jacket 176. Also, for filled cables, the core 32 is filled with a waterproofing material after which the core wrap 33 is applied and bound. Subsequently, aluminum or aluminum and steel shields are formed about the wrapped core.

Figure 19:
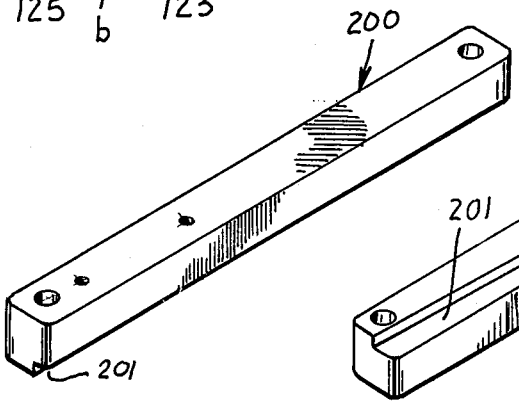
FIG. 19 is a perspective view of a key of the tooling of FIG. 18.
Figure 20:
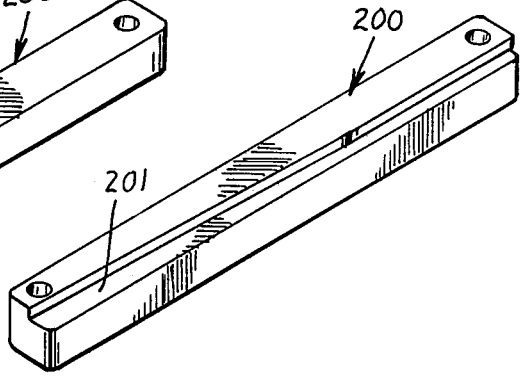
FIG. 20 is a perspective view of the key of FIG. 19 in an inverted and rotated position.
Figure 18:
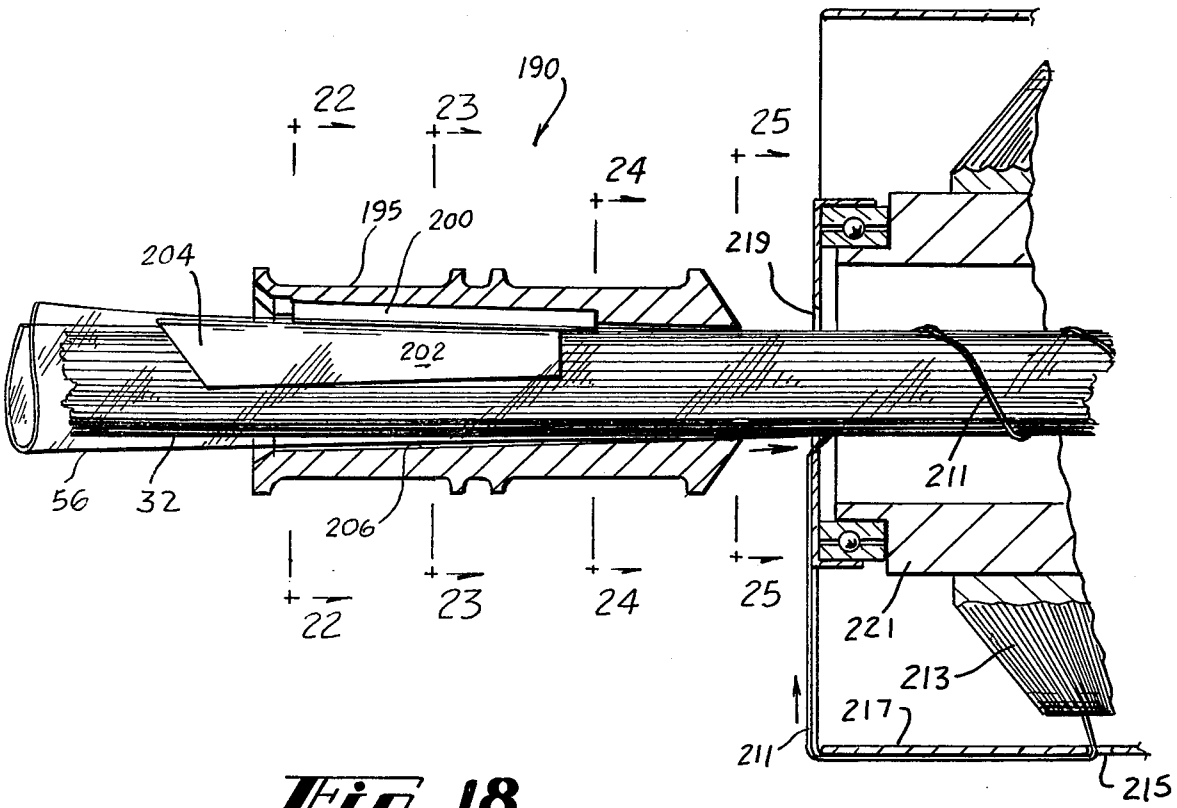
FIG. 18 is an elevational view of tooling and of a binder head for forming a core wrap about an advancing cable core and for binding the wrap.

In those instances, the core wrap material such as, for example, the strip 56 of plastic material is applied by an apparatus 190 (see FIG. 18) having a tool 195 similar to the tool 99. The key 100 is replaced with a key 200 (see also FIGS. 19–21) having only one longitudinally extending guideway 201. Only one is required inasmuch as this key is not used to form a shield simultaneously with the core wrap. As can be seen in FIG. 18, a shoe 202 having a projecting end 204 is attached to the key 200.

Figure 22:
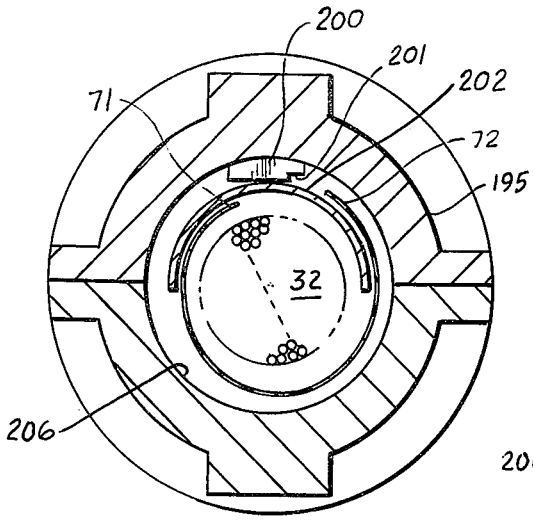
FIGS. 22–25 are a sequence of end cross-sectional views taken along the tooling shown in FIG. 18 with the core wrap at different stages in its formation.
Figure 23:
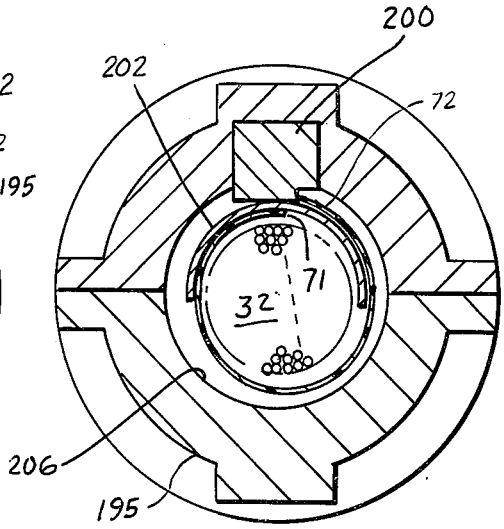

The key 200 extends longitudinally along a portion of a converging passageway 206 in the tool 195. As can be seen in FIGS. 22–23, the single guideway 201 is effective to receive the longitudinal edge portion 72 of the strip 56 after the strip has been partially formed as before while the other longitudinal edge portion 71 is supported by the inner surface of the shoe 202.

Figure 24:
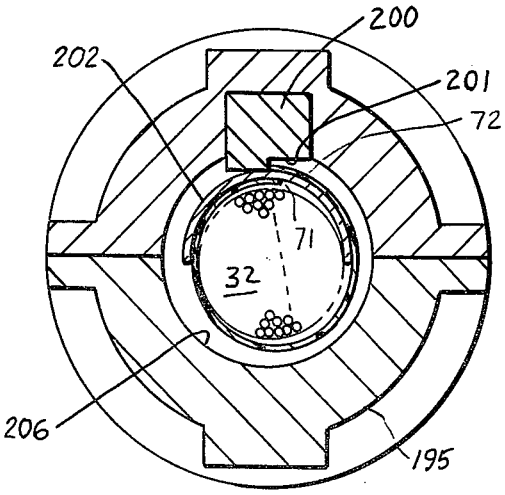

The guideway 201 in the key 200 becomes deeper into the key as it extends along the converging passageway 206 (see FIG. 24). As a result, as the strip 56 is advanced through the converging passageway 206, its outer longitudinal edge 72 moves farther into the key. Simultaneously, the inner longitudinal edge portion 71 is caused to be moved farther around the inner surface of the shoe 202.

Figure 25:
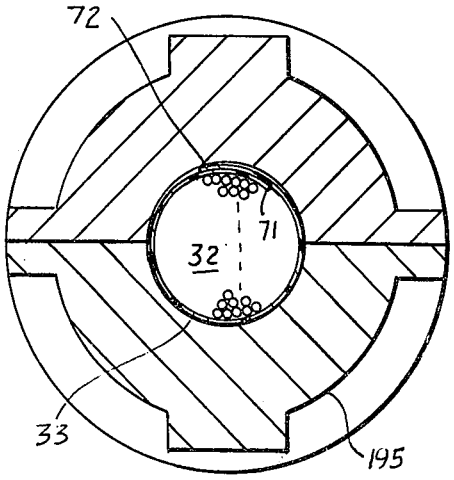

The cooperation of the guideway 201 and the converging passageway 206 controls the relative circumferential movement between the longitudinal edge portions 71 and 72 of the strip 56. The wall of the guideway 201 is effective to apply forces to the longitudinal edge surface of the strip 56 to hold it in engagement with the wall of the passageway 206. As a result, the core 32 is caused to be enclosed with a non-metallic substantially tubular cover (see FIG. 25) which is in substantial engagement with core 32 and which has a longitudinal overlapped seam.

Prior to a subsequent extrusion step, for example, the core wrap 33 is caused to be held in place by the application of a binder ribbon 211 (see FIG. 18). The binder ribbon 211 is fed from a supply 213 through an opening 215 in a driven shroud 217. From there, it is passed through an opening 219 in a freely rotatable housing 221 in a spiralling manner onto the advancing core 32. However, the binder is applied to the already formed core wrap 33 and unlike the prior art is not used to draw down the strip 56.

While the instant invention has been described with respect to cables having a core wrap 33 and a shield of aluminum, it should be understood that it may be utilized to form a cable having more than one shield. In those instances, the apparatus of this invention is used to dispose the core wrap and the inner shield about the core. Subsequently, tooling such as that disclosed and claimed in the aforementioned Bohannon patent is used to edge form the outer shield.

It is to be understood that the above-described arrangements are simply illustrative of the invention. Other arrangements may be devised by those skilled in the art which will embody the principles of the invention and fall within the spirit and scope thereof.

What is claimed is:

1. A method of forming non-metallic and metallic covers about a cable core, said method including the steps of:

moving a cable core, a strip of relatively flexible non-metallic material and a strip of metallic material along a path of travel; while forming the strips along one portion of the path of travel to cause each to enclose partially the core;

providing a passageway along another portion of the path of travel which converges in the direction the core is being moved to cause longitudinal edge portions of each strip to be moved circumferentially of the core;

causing the longitudinal edge portions of the partially formed non-metallic strip to be separated in a direction radially of the path of travel without restricting their movement circumferentially of the core; and then confining one longitudinal edge portion of the non-metallic strip and the longitudinal edge portions of the metallic strip along a portion of the converging passageway to control the relative circumferential movement between the edge portions of each strip and cause each strip to be formed into a tubular cover with an overlapped seam having a predetermined configuration.

2. The method of claim 1, wherein the overlapped seams of the non-metallic and the metallic covers are aligned radially of the core.

3. The method of claim 1, wherein the step of forming includes causing the strip of non-metallic material to have a curved cross-section at an entrance to the one portion of the path of travel and then causing each strip to be wrapped substantially about the advancing cable core with a gap between longitudinal edge portions thereof.

4. The method of claim 1, wherein the metallic and the non-metallic strips are overlapped to cause the circumferential direction from the inner to the outer longitudinal edge portion of the non-metallic cover to be opposite that for corresponding edge portions of the metallic cover.

5. The method of claim 1, wherein said step of confining the one longitudinal edge portion of the non-metallic strip includes providing a first guideway having walls which apply forces to the one longitudinal edge portion of the non-metallic strip and one longitudinal edge portion of the metallic strip and a second guideway having walls which apply forces to the other longitudinal edge portion of the metallic strip to control the movement thereof in a direction circumferentially of the core and to cause the other longitudinal edge portion to be directed inwardly into engagement with the one longitudinal edge portion of the metallic strip, the longitudinal edge portions of the non-metallic strip being separated until they have been overlapped.

6. A method of forming a tubular cover about a cable core, said method including the steps of:

moving a cable core and a strip of relatively flexible non-metallic material along a path of travel; while forming the strip along one portion of the path of travel to enclose partially the core;

providing a passageway along another portion of the path of travel which converges in the direction in which the core is moved to cause longitudinal edge portions to be moved circumferentially of the core;

causing the longitudinal edge portions of the partially formed strip to be separated in a direction radially of the path of travel without restricting their movement circumferentially of the core; then confining one longitudinal edge portion of the strip to control the relative circumferential movement between the separated longitudinal edge portions as the strip is moved along a portion of the converging passageway and cause the strip to be formed into a tubular cover which is in substantial engagement with the core and which has a longitudinal overlapped seam; and securing the tubular cover in engagement with the cable core.

7. The method of claim 6, wherein said step of securing the tubular cover in engagement with the cable core is accomplished by applying a ribbon about the non-metallic material after it has been formed about the core.

8. The method of claim 6, wherein the non-metallic material is a plastic material.

9. The method of claim 6, wherein the non-metallic material is a fibrous material.

10. The method of claim 6, wherein the step of forming includes causing the strip of non-metallic material to have a curved cross-section at an entrance to the one portion of the path of travel and then causing the strip to be wrapped substantially about the advancing cable core with a gap between longitudinal edge portions thereof.

11. An apparatus for forming non-metallic and metallic covers about a cable core, said apparatus including:

moving means for advancing a cable core, a strip of relatively flexible non-metallic material and a strip of metallic material together along a path of travel;

forming means disposed along one portion of the path of travel for causing each strip to enclose partially the core;

a passageway which is disposed concentrically about another portion of the path of travel and which converges in the direction the cable core is being advanced for causing longitudinal edge portions of each strip to be moved circumferentially of the core;

separating means for causing the longitudinal edge portions of the strip of non-metallic material to be separated in a direction radially of the path of travel without restricting their movement circumferentially of the core; and guiding means positioned along the converging passageway for confining one longitudinal edge portion of the non-metallic strip and both longitudinal edge portions of the metallic strip to control the relative circumferential movement between the longitudinal edge portions of each strip and cause each strip to be formed into a tubular cover having an overlapped seam.

12. The apparatus of claim 11, wherein said forming means includes a tube through which the core is advanced, said tube having a circumference which is greater than the width of each strip to cause the longitudinal edge portions of each strip to be spaced apart at an exit end of said tube, said forming means also including a conically shaped member disposed about the one portion of the path of travel for causing the strips of non-metallic and metallic material to enclose partially the core.

13. The apparatus of claim 12, which also includes slot means for causing the strip of non-metallic material to have a curved cross-section at an entrance to said conically shaped member.

14. The apparatus of claim 13, wherein said guiding means includes a key having a longitudinally extending guideway which is disposed at an angle to a centerline of said converging passageway and being used to confine the one longitudinal edge portion of the non-metallic strip and a longitudinal edge portion of the metallic strip, and said separating means includes a longitudinally extending shoe which is adjacent to said key and which has a curved configuration with free longitudinal edges depending away from said key, the other longitudinal edge portion of the non-metallic strip being in engagement with an inner surface of said shoe as the non-metallic strip is advanced through said passageway.

15. The apparatus of claim 14, wherein one end portion of said shoe extends beyond an entrance to said key toward said forming means, said one end portion of said shoe being beveled in a direction radially of the core.

16. The apparatus of claim 14, wherein said guiding means also includes a second guideway on an opposite side of said key along which is moved the other longitudinal edge portion of the metallic strip, said guideways in said key causing the other edge portion of the metallic strip to overlie and to be directed inwardly into substantially continuous engagement with the one longitudinal edge portion thereof while supporting the underlying edge portion to prevent its deflection inwardly toward a longitudinal axis of the core.

17. The apparatus of claim 11, wherein said separating means and said guiding means cooperate to cause the seams to be overlapped such that the circumferential direction from the inner longitudinal edge portion of the non-metallic cover to its outer longitudinal edge portion is opposite to that for corresponding edge portions of the metallic cover.

18. The apparatus of claim 11, wherein the overlapped seams are aligned radially of the core.

19. An apparatus for forming a tubular cover about a cable core, said apparatus including:

moving means for advancing a cable core and a strip of relatively flexible non-metallic material along a path of travel;

forming means disposed along one portion of the path of travel for causing the strip to enclose partially the core;

a passageway which is disposed concentrically about another portion of the path of travel and which converges in the direction along which the cable core is advanced for causing longitudinal edge portions of the strip to be moved circumferentially of the core;

separating means for causing the longitudinal edge portions of the strip to be separated in a direction radially of the path of travel and for allowing them to be moved circumferentially of the core;

guiding means positioned along a portion of the converging passageway for confining one longitudinal edge portion of the strip to control the relative circumferential movement between the separated longitudinal edge portions as the strip is moved through the converging passageway to cause the other longitudinal edge portion to become disposed between the core and the one edge portion and cause the non-metallic strip to be formed into a tubular cover which is in substantial engagement with the core and which has an overlapped seam; and securing means for causing the tubular cover to be held in engagement with the cable core.

20. The apparatus of claim 19, wherein said forming means includes a tube through which said core is advanced and about which the strip becomes disposed, said tube having a circumference which is greater than the width of the strip to cause the longitudinal edge portions of the strip to be spaced apart at an exit end of said tube, said forming means also including a conically shaped member disposed about the one portion of the path of travel and cooperating with said tube for causing the strip of non-metallic material to enclose partially the core.

21. The apparatus of claim 20, which also includes slot means for causing the strip of non-metallic material to have a curved cross-section at an entrance to said conically shaped member.

22. The apparatus of claim 19, wherein said guiding means includes a key having a longitudinally extending guideway which is disposed at an angle to a centerline of said converging passageway and which is used to confine the one longitudinal edge portion of the non-metallic strip and said separating means includes a longitudinally extending shoe which is attached to said key and which has a curved configuration with free longitudinal edges depending away from said key, the other longitudinal edge portion of the strip being in engagement with an inner surface of said shoe as the strip is advanced through said passageway.

23. The apparatus of claim 22, wherein one end portion of said shoe extends beyond an entrance to said key toward said forming means to facilitate the guiding of the one longitudinal edge portion of the strip of non-metallic material into the guideway of said key, said one end portion of said shoe being beveled in a direction radially of the core.

* * * * *